United States Patent [19]

Sosnowski et al.

[11] 4,173,959

[45] Nov. 13, 1979

[54] LIQUID FUEL INJECTION PUMPS

[75] Inventors: Stanislaw J. A. Sosnowski; James C. Potter, both of London, England

[73] Assignee: Lucas Industries Limited, Birmingham, England

[21] Appl. No.: 899,403

[22] Filed: Apr. 24, 1978

[30] Foreign Application Priority Data

Apr. 30, 1977 [GB] United Kingdom ..... 18168/77

[51] Int. Cl.[2] ..... F02M 39/00; F04B 19/02; F04B 3/00

[52] U.S. Cl. ..... 123/139 AP; 417/462; 123/139 AL; 123/139 AN; 417/254

[58] Field of Search ..... 417/462, 244, 254, 219; 123/139 ST, 179 L, 139 AL, 139 AM, 139 AN, 139 AP

[56] References Cited

U.S. PATENT DOCUMENTS

| | | | |
|---|---|---|---|
| 2,989,003 | 6/1961 | Evans | 417/462 |
| 3,074,351 | 1/1963 | Foster | 417/244 |
| 3,228,339 | 1/1966 | Evans | 417/462 |
| 4,083,345 | 4/1978 | Davis | 123/139 ST |
| 4,098,249 | 7/1978 | Mowbray | 123/139 ST |

FOREIGN PATENT DOCUMENTS

| | | | |
|---|---|---|---|
| 1254476 | 12/1971 | United Kingdom | 417/462 |
| 167404 | 2/1965 | U.S.S.R. | 417/462 |
| 266468 | 7/1970 | U.S.S.R. | 417/462 |

*Primary Examiner*—Charles J. Myhre
*Assistant Examiner*—Carl Stuart Miller

[57] ABSTRACT

A fuel injection pumping apparatus for supplying fuel to an internal combustion engine includes an injection pump comprising a pair of reciprocable plungers located in a bore and moved inwardly in timed relationship by cam lobes formed on an annular cam ring. The bore containing the plungers is connected to a delivery passage whereby fuel is delivered in turn during successive inward movement of the plunger to a plurality of outlet ports. Fuel is supplied to the injection pump by way of valve means from a further pump, also incorporating a pair of reciprocable plungers movable inwardly by means of cam lobes on a cam ring. The displacement of the plungers of the further pumps is greater than that of the plungers of the injection pump and means is provided to alter the stroke of the plungers of the further pump during which fuel is supplied to the injection pump. In one example this is achieved by means of a spill port which is brought into register with the bore containing the plungers of the further pumps and in addition the cam ring of the further pump is angularly adjustable.

27 Claims, 10 Drawing Figures

LIQUID FUEL INJECTION PUMPS

This invention relates to liquid fuel injection pumping apparatus for supplying fuel to internal combustion engines and of the kind comprising a housing, a rotary distributor member located in the housing, an injection pump including a bore formed in the distributor member, a pump plunger located in said bore, and cam means for imparting inward movement to said plunger as the distributor member rotates, a delivery passage in the distributor member through which the fuel displaced from the bore during the inward movement of the plunger flows, and a plurality of outlet ports in the housing, said delivery passage communicating with said outlet ports in turn as the distributor member rotates so that the fuel displaced during successive inward movements of the plunger will flow to the outlet ports in turn.

It is necessary when fuel is supplied to a diesel engine to carefully control the maximum volume of fuel which is delivered to the engine during normal running primarily to ensure that the level of smoke in the engine exhaust does not exceed the level set by exhaust emission regulations. It is also necessary to be able to provide a greater volume than the aforesaid maximum volume for starting purposes and it is sometimes necessary to be able to adjust the aforesaid maximum volume as the speed of the engine varies.

It is known to use an inlet metering shuttle arrangement whereby a predetermined volume of fuel is stored in one and of a cylinder containing a hydraulically actuated shuttle and during the filling period of the injection pump, to displace the shuttle thereby to transfer the aforesaid volume of fuel into the injection pump. The maximum excursion of the shuttle determines the normal maximum volume of fuel. With a practical construction it has been found that there is a substantial and unacceptable variation in the maximum volume of fuel delivered by the injection pump during the injection strokes as the speed at which the pump is driven is increased. This is thought to be associated with cavities which are formed in the fuel when the shuttle strikes a stop at the end of its stroke. There are other problems with the construction and these are centered around the generation of the hydraulic pressure for actuating the shuttle. At very low speeds, e.g. at starting, the pressure available for moving the shuttle is low whilst at high speeds the pressure may be undesirably high and will tend to encourage the formation of the cavities as described.

The object of the present invention is to provide an apparatus of the kind specified in a simple and convenient form.

According to the invention a pump of the kind specified comprises a further bore in the distributor member or in a part rotatable therewith, a further plunger in said further bore, conduit means connecting said bores, further cam means for imparting inward movement to said further plunger as the distributor member rotates, said further cam means being positioned so that fuel will be displaced from said further bore through said conduit means to said first mentioned bore whilst the delivery passage is out of register with the outlet ports, valve means in said conduit means operable to allow fuel to flow to said first mentioned bore but to prevent the reverse flow of fuel, said valve means and/or said conduit means acting to ensure restriction to the flow of fuel to the first mentioned bore, and means operable in conjunction with said further cam means to determine the length of the stroke of said further plunger during which fuel can be delivered to said first mentioned bore.

An example of a fuel injection pumping apparatus in accordance with the invention will now be described with reference to the accompanying drawings, in which.

Figure 3:
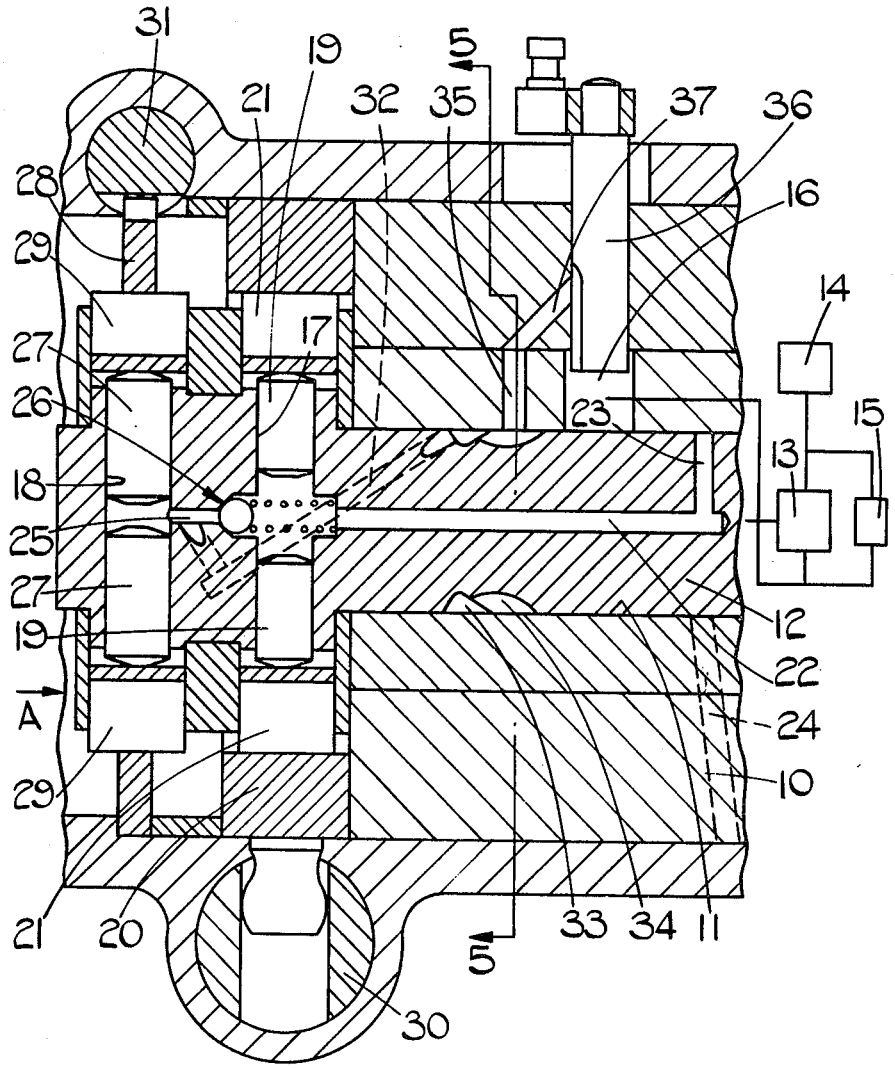
FIG. 3 is a sectional side elevation showing part of a practical form of the apparatus.

Referring firstly to FIG. 3 of the drawings, the apparatus comprises a multi-part housing generally indicated at 10 and which defines a cylindrical cavity 11 in which is mounted a rotary cylindrical distributor member 12. The distributor member is adapted to be driven in timed relationship with an associated engine by means of a drive shaft not shown and it is also coupled to the rotary part of a fuel feed pump indicated at 13. The feed pump draws fuel from a source 14 and it delivers fuel under pressure which is controlled by a valve 15, to a chamber 16 which is formed in the housing.

Formed in the distributor member are a pair of transversely extending bores 17, 18 the bore 18 having a slightly larger diameter than the bore 17. Located in the bore 17 is a pair of pumping plungers 19 and these are movable inwardly as the distributor member rotates, by means of cam lobes formed on the internal peripheral surface of an annular cam ring 20, rollers 21 being interposed between the plungers 19 and the cam lobes in the usual manner. The plungers 19 define with the bore 17 the pumping chamber of the injection pump and this chamber communicates with a longitudinal passage 22 formed in the distributor member and communicating with an outwardly extending delivery passage 23 which opens onto the periphery of the distributor member. The delivery passage is positioned to register in turn and as the distributor member rotates, with a plurality of outlet ports 24 (only one of which being shown) and which in use communicate with the injection nozzles of the associated engine. The communication of the delivery passage 23 with an outlet port 24 occurs whenever the plungers 19 can be moved inwardly by the cam lobes.

Interconnecting the bores 17 and 18 is a conduit 25 in which is located a non-return valve 26 this comprising a ball valve element which is loaded into contact with a seating by means of a coiled compression spring. The non-return valve 26 is positioned to allow fuel from the bore 18 to the bore 17 but to prevent the return flow of fuel.

Located in the bore 18 is a further pair of plungers 27 and these are movable by means of cam lobes formed on a cam ring 28 which is positioned within the housing and spaced from the cam ring 20. Rollers 29 are positioned between the plungers 27 and the cam ring.

It will be noted that the angular position of the cam ring 20 is adjustable within the housing such adjustment being effected by a fluid pressure operable piston 30 this having the effect of altering the timing of delivery of fuel. The angular position of the cam ring 28 is also adjustable such adjustment being effected in the particular example, by means of a member 31 which is movable tangentially to the cam ring 28 and which is connected to the cam ring by means of interengaging teeth as shown in FIG. 4, the effect of adjusting the ring 28 being to adjust the quantity of fuel supplied as will be explained.

Figure 4:
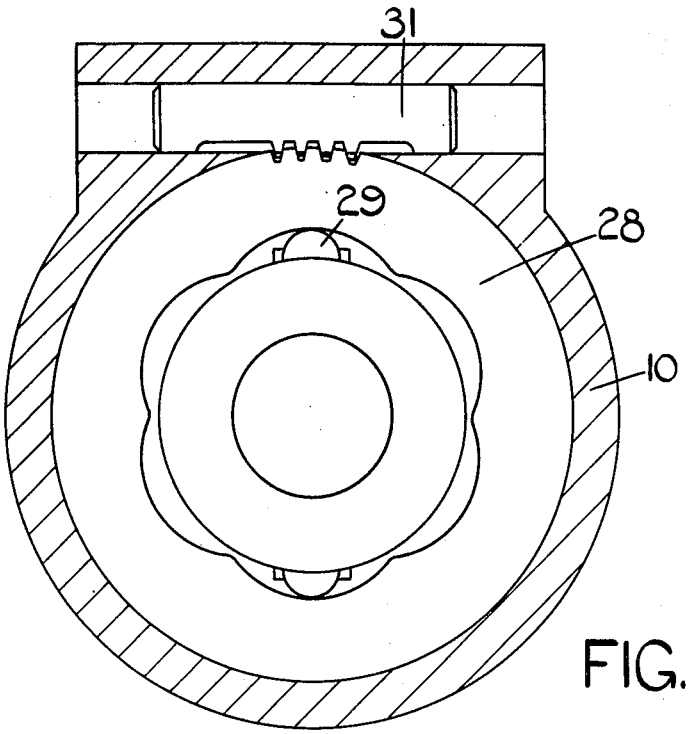
FIG. 4 is an end view in the direction of Arrow A of FIG. 3.
Figure 5:
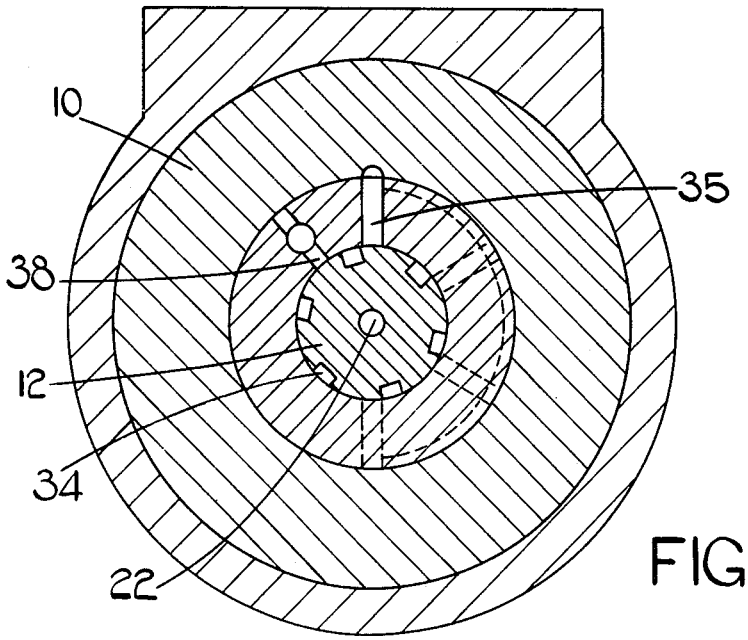
FIG. 5 is a section on the line 5—5 of FIG. 3.

The apparatus as shown in FIGS. 3, 4 and 5 is for supplying fuel to a six cylinder engine and hence there will be six outlet ports 24 and six cam lobes on each of the cam rings 20 and 28. This means that for one revolution of the distributor member, each outlet port 24 will receive a quantity of fuel.

The bore 18 together with the plungers 27 constitutes a low pressure pump which delivers fuel to the pumping chamber of the injection pump by way of the non-return valve 26 and in order to supply fuel to the low pressure pump a supply passage 32 is formed in the distributor member and which communicates with the low pressure pump downstream of the non-return valve. The supply passage 32 is in communication with a circumferential groove 33 formed on the distributor member and this in turn is in communication with six equiangularly spaced and longitudinally extending grooves 34 also formed in the periphery of the distributor member. The grooves 34 are positioned to register in turn with an inlet port 35 and this is in communication with the aforesaid chamber 16 by way of a throttle. The throttle is constituted by an angularly movable throttle member 36 which is provided with a longitudinal groove communicating at one end with the chamber 16 and having variable communication depending upon the angular position of the throttle member, with a port 37 communicating with the inlet port 35. In FIG. 5 additional inlet ports are shown in dotted outline and these may be provided in the event that more rapid filling of the low pressure pump is required. Also shown in FIG. 5 is a spill port 38 which is positioned to register with the grooves 34 during rotation of the distributor member. The port 38 contains a non-return valve (not shown).

Figure 1:
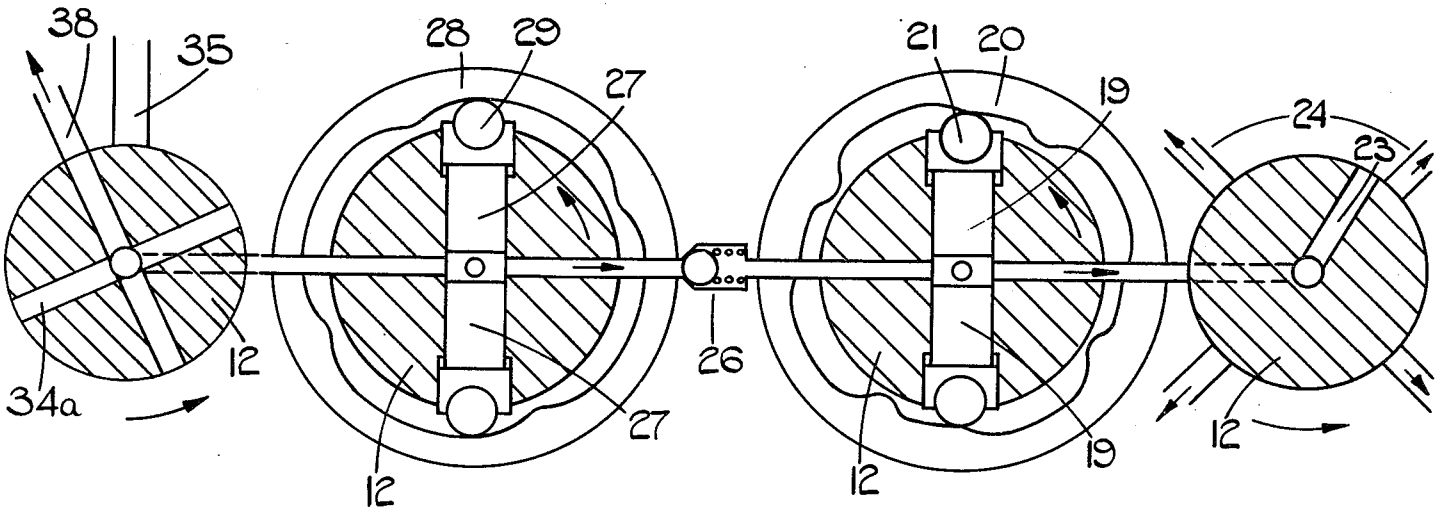
FIG. 1 is a diagrammatic representation of the apparatus.
Figure 2:
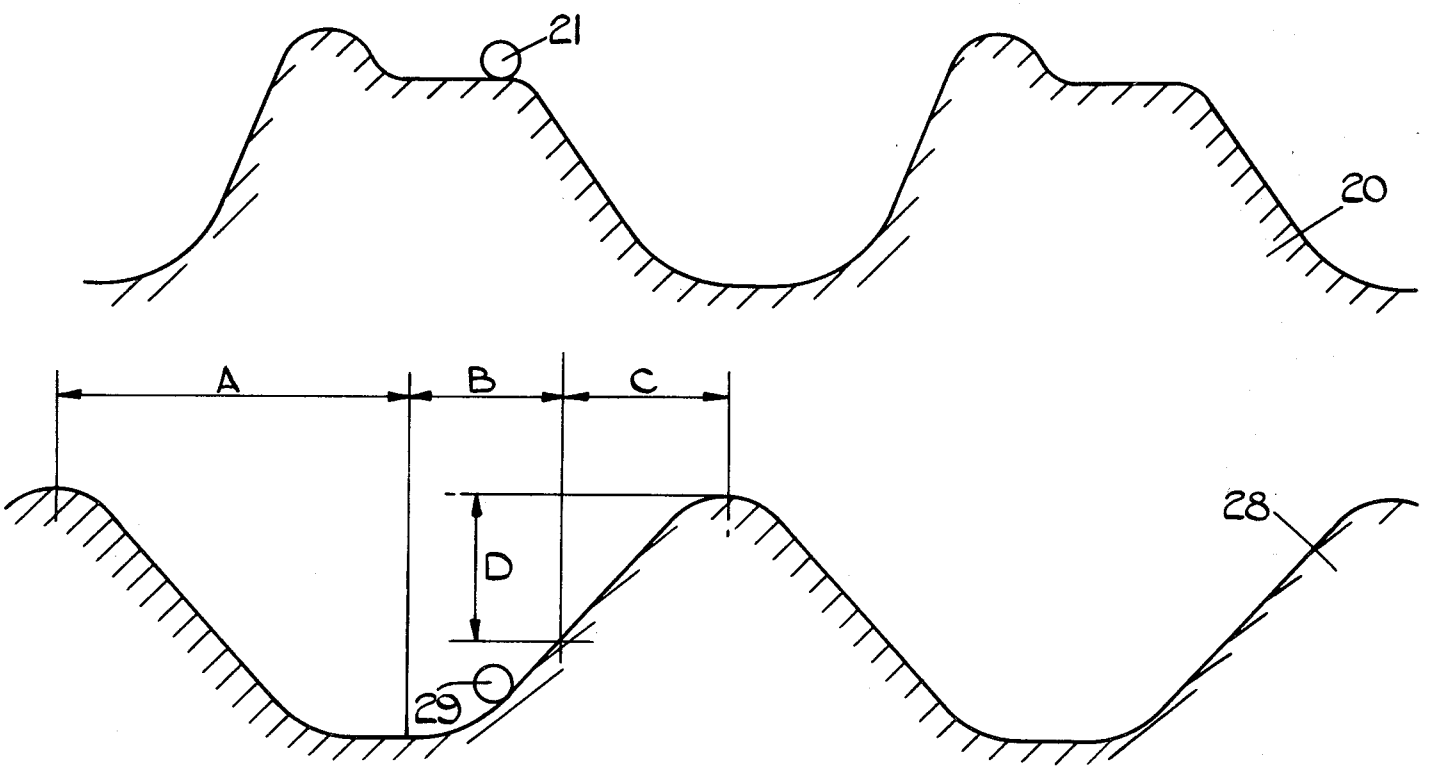
FIG. 2 is a drawing showing two cam profiles of the apparatus.

For an explanation of how the apparatus operates it is proposed to refer to FIGS. 1 and 2. As previously stated FIG. 1 is a diagrammatic representation of the apparatus and identical reference numerals have been used in FIG. 1 to those used in FIG. 3. The only significant difference in FIG. 1 is that instead of showing grooves 34 they have been replaced by passages 34*a*. Moreover, the pump shown in FIG. 1 is for supplying fuel to a four cylinder engine.

The distributor member 12 is shown in four sections and the direction of rotation of the distributor member is indicated by the curved arrows. The profiles of the lobes on the cam rings 20 and 28 are shown in FIG. 2. The positions of the rollers 21, 29 correspond to the position of the apparatus shown in FIG. 1. In FIG. 1 it will be observed that the delivery passage 23 has just moved out of register with an outlet port 24 and the rollers 21 and plunger are about to be allowed to move outwardly by the cam lobe. There has just occured, a period of retraction which is for the purpose of reducing pressure within the pumping chamber of the injection pump and the delivery passage and outlet to allow closure of a delivery valve and rapid closure of the valve member of the nozzle. Following this period the plungers 19 can move outwardly to their maximum extent during which time fuel is supplied to the bore 17. When the rollers 21 encounter the lobes again they will be moved inwardly to displace fuel to an outlet and thereafter the cycle is repeated. The point at which delivery starts depends upon the amount of fuel which is supplied to the pumping chamber of the injection pump during the filling stroke. The start of delivery can also be varied by moving the cam ring 20 angularly by means of the piston 30. It will be appreciated by those skilled in the art that before inward movement of the plungers 19 can take place, the delivery passage 23 must be in communication with an outlet port to avoid the creation of excessively high pressures in the pumping chamber of the injection pump.

Filling of the pumping chamber of the injection pump is achieved by fuel which is displaced by the plungers 27 and which flows past the non-return valve 26. This valve whilst fuel is being delivered by the injection pump is tightly closed so that the high pressure fuel within the pumping chamber of the injection pump does not flow into the low pressure pump.

The operation of the low pressure pump in many respects is similar to that of the injection pump and during the initial description it will be assumed that the throttle member 36 is open to its maximum extent. Filling of the low pressure pump takes place during the period referenced A in FIG. 2, and as will be understood the filling of the low pressure pump has taken place and the passage 34*a* has moved out of register with the port 35.

The actual amount of fuel which is delivered from the low pressure pump to the injection pump past the non-return valve 26 is determined by varying the setting of the cam ring 28 relative to the spill port 38. The low pressure pump can be set to ensure that the injection pump is completely filled with fuel. This situation is required for the purpose of obtaining excess fuel for starting the associated engine. Normally the low pressure pump would supply to the injection pump a quantity of fuel less then the maximum displacement of the injection pump and the control of this quantity is determined by spilling fuel from the low pressure pump during inward movement of the plungers 27 either at the beginning (as shown), of the inward movement or towards the end of the inward movement.

Considering the first case, a passage 34*a* is in registration with the spill port 38 and the plungers have moved inwardly. The initial inward movement of the plungers 27 will displace fuel through the spill port and only when the spill port is closed will fuel be displaced from the low pressure pump to the injection pump. The period B during which spill takes place depends upon the angular setting of the cam ring 28 in relation to the spill port 38 and if only a small volume of fuel is spilled then more fuel will be delivered to the injection pump. The period of transfer is indicated at C and the amount of fuel transferred is represented by D.

In the second case the spill port is positioned so that the fuel is spilled towards the end of the inward movement of the plungers 27 and again adjustment of the cam ring 28 will determine how much fuel is spilled and therefore the amount of fuel which is supplied to the high pressure pump.

It will be seen therefore that in either of the cases mentioned above if the cam ring 28 is fixed, then the injection pump will deliver a predetermined volume of fuel and this can be said to represent the normal maximum quantity of fuel. For starting purposes the cam ring 28 can be adjusted so that more fuel is supplied to the injection pump during the filling thereof. It will be appreciated also that if the cam ring 28 is moved then the maximum quantity of fuel varies and the cam ring 28 can be moved to effect variation in the maximum quantity of fuel for the purpose of torque control etc. In the specific embodiment where transfer takes place following spill, the spill port can be shaped so that transfer of fuel does start to take place before the spill port is actually closed. In this manner the maximum fuel delivery/speed curve can be tailored so that as the speed increases a gradual increase in the amount of fuel transferred to the injection pump takes place for a given setting of the cam ring 28.

With the arrangements described the transfer of fuel to the injection pump is achieved in a positive manner without the need as in prior art devices, to rely on a fluid pressure. The rate of transfer of fuel is high but nevertheless can be controlled by shaping the leading faces of the lobes on the cam ring 28. Moreover, the pressure of fuel generated in the low pressure pump is determined by the strength of the spring in the non-return valve. If the force exerted by the spring is high then the pressure generated will be increased but at the same time the risk of cavities forming will be minimized as also will any inertia effects of the plungers 27 and associated components.

It is not always required to supply the maximum amount of fuel to the engine it is capable of consuming and this is the purpose of the throttle 36. If the throttle 36 is set such that the low pressure pump is not completely filled with fuel then less fuel will be delivered to the injection pump and therefore the power output of the engine will be reduced. As previously mentioned the setting of the throttle member 36 can be determined by a speed governor which includes a governor spring the force exerted by which can be adjusted by an operator adjustable control so that spaced governing action can be obtained.

In the pump described so far a throttle has been provided to determine the amount of fuel supplied to the engine when the required amount is less than the normal maximum value.

It is perfectly possible to eliminate the throttle 36 and to effect complete control over the amount of fuel supplied by moving the cam ring 28 angularly. In this instance positive stops must be provided for the cam ring so that the maximum fuel quantity is positively determined. The cam ring itself however may be connected to the governor mechanism.

It is possible to adjust the length of the strokes of the plungers 27 during which fuel is supplied to the injection pump in other ways. In the arrangement shown in FIG. 6 the low pressure pump plungers are again indicated by the reference numeral 27 but the cam ring 28 is replaced by an annular guide member 40 which is fixed within the housing and which defines radial slots which accommodate radially movable rollers 41 respectively. The rollers 41 are the equivalent of the cam lobes on the cam ring 28 and shaped shoes 42 may be provided respectively between the plungers and rollers. The shoes 42 as the distributor member rotates, engage the rollers and inward movement is imparted to the plungers 27. The position of the rollers 41 in the respective slots, is determined by an annular cam member 43 having cam surfaces which engage the rollers 41. The cam member 43 is angularly adjustable and it will be seen if it is moved in the clockwise direction in FIG. 6, the rollers 41 will move inwardly. Such inward movement means that the displacement of the plungers 27 is increased and therefore more fuel will be supplied to the injection pump. In this case the spill port 38 is omitted. When the throttle 36 is also omitted the low pressure pump will be completely filled with fuel and this volume of fuel will be displaced to the injection pump. In this case the control of the amount of fuel supplied to the injection pump under all conditions of operation, will be determined by the angular setting of the cam member 43.

Figure 6:
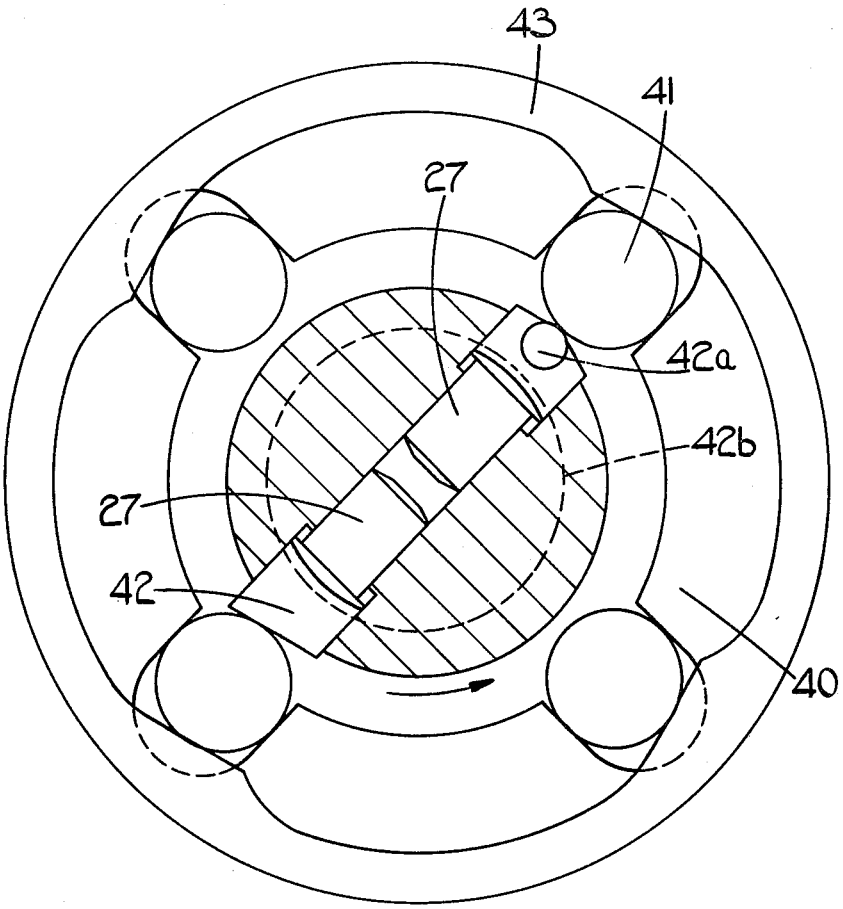
FIG. 6 is a cross-sectional side elevation of a modification of the apparatus.

It is of course possible with the arrangement of FIG. 6 to utilise the throttle 36 so that the cam member 43 is only adjusted when it is required to vary the maximum quantity of fuel which can be supplied to the engine.

It is desirable with the arrangement shown in FIG. 6 to control the movement of the plungers and shoes in the outwards direction and for this purpose stop means is provided to limit the outward movement of the plungers and shoes. This stop means may take the form of pins fixed to the distributor member and located in slots in the walls of the plungers or as shown, stop plates or rings **42*b*** are provided which engage with the shoes to limit the outward movement of the plungers and shoes.

FIG. 6 shows a modification where instead of shaped shoes 42, rollers **42*a* are provided for co-operation with the rollers 41, the rollers 42*a*** being supported by conventional shoes.

In all the examples shown the non-return valve is mounted in the distributor member. It can however be mounted within the housing in a special chamber defining a seating for the valve member. The opposite ends of the chamber can be in constant communication with the bores 17, 18 respectively or both ends of the chamber may have ported communication with the bores, i.e. only communicating with the bores when it is required to transfer fuel or one end only may be ported. If one end is to be ported then it is preferred that it is the end required to communicate with the bore 17 which is ported because then during the delivery of fuel to the engine, the non-return valve will be shielded from the high pressure of fuel.

By correctly positioning the porting it is possible to eliminate the non-return valve.

The non-return valve 26 acts to restrict the flow of fuel and thereby ensures that a positive pressure is generated in the bore 18. As mentioned this minimizes the risk of cavitation. Where the non-return valve 26 is omitted the porting provides the function of the non-return valve in controlling the flow of fuel and therefore acts as a valve in this respect. The porting may also impose sufficient restriction to the flow of fuel to provide the positive pressure in the bore 18. If it does not then a restrictor can be provided at some position in the flow path controlled by the porting. The provision of the non-return valve in the distributor member does mean that there is only one passage which is subject to high pressure, i.e. the passage 23, opening onto the periphery of the distributor member. The leakage of fuel at high pressure is therefore less than a conventional pump or in the examples of the present pump where the non-return valve or its equivalent, i.e. the porting are in the housing.

Whilst not essential with pumps which have been properly adjusted it is thought desirable to provide a relief valve through which fuel can escape from the bore 18 in the event that for some reason or other, an excessive pressure is generated in the bore. Such a pressure could be generated if for instance the plungers 27 started to move inwardly before the plungers 19 could move outwardly.

Figure 7:
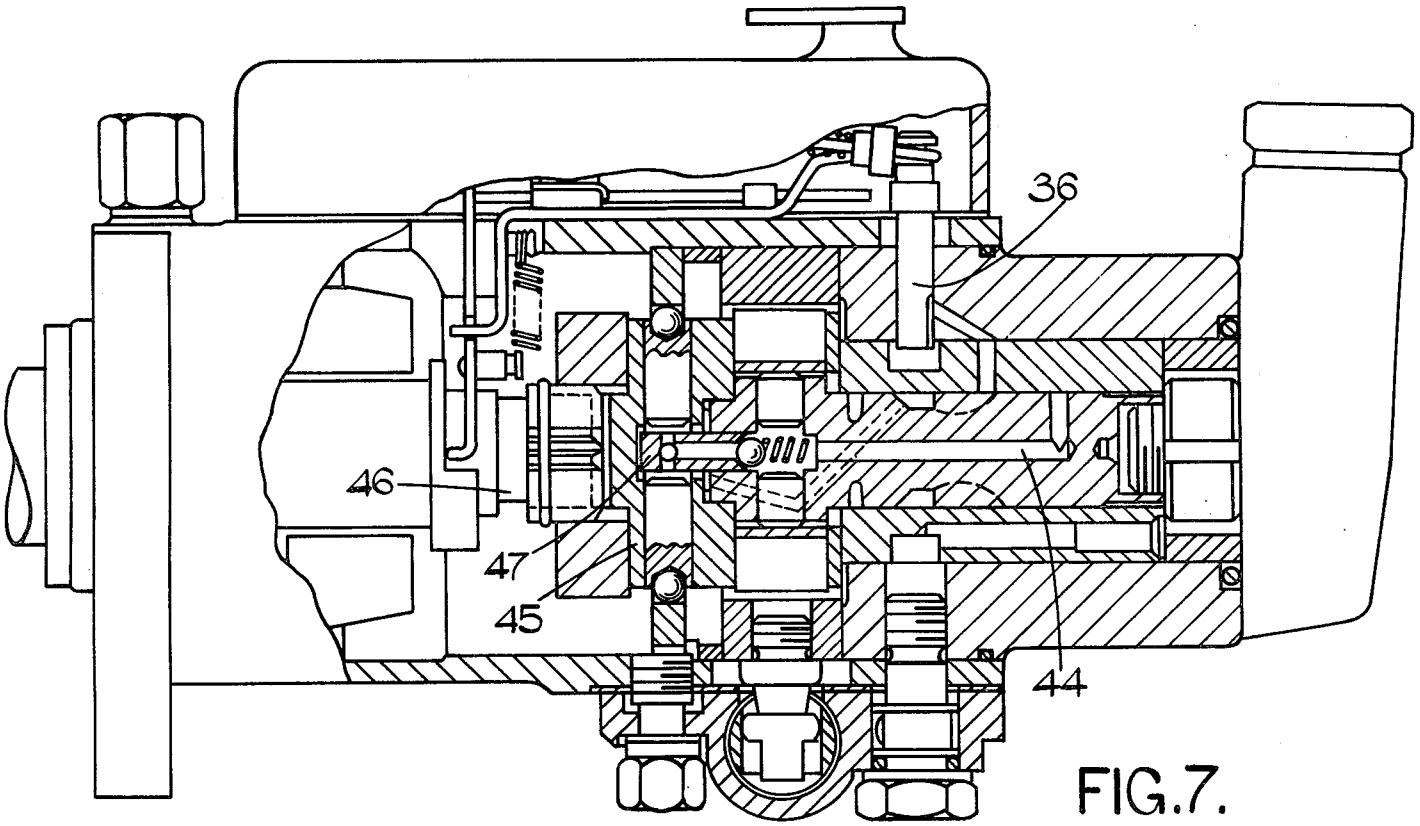
FIG. 7 shows a part sectional side elevation a further practical form of the apparatus.

A further advantage of the apparatus described is that it can use with very little modification, many of the components of an existing distributor type pump. A cross-section of the modified pump is shown in FIG. 7 and in the arrangement shown in FIG. 7 it will be noted that the rotary part of the pump referred to so far as the distributor member, is formed in two parts which are referenced 44 and 45. The part 44 is substantially identical to the distributor member of a pump which is at present in production whilst the part 45 forms the connection between the part 44 and the drive shaft 46. The part 45 houses the low pressure pump and the conduit 25 seen in FIG. 3, is formed in a connecting piece which extends between the parts 44 and 45. The connecting piece referenced 47 is detachable so that the spring which loads the ball can be inserted in position. FIG. 7 also shows a mechanical governor for determining the angular setting of the throttle member 36.

Figure 8:
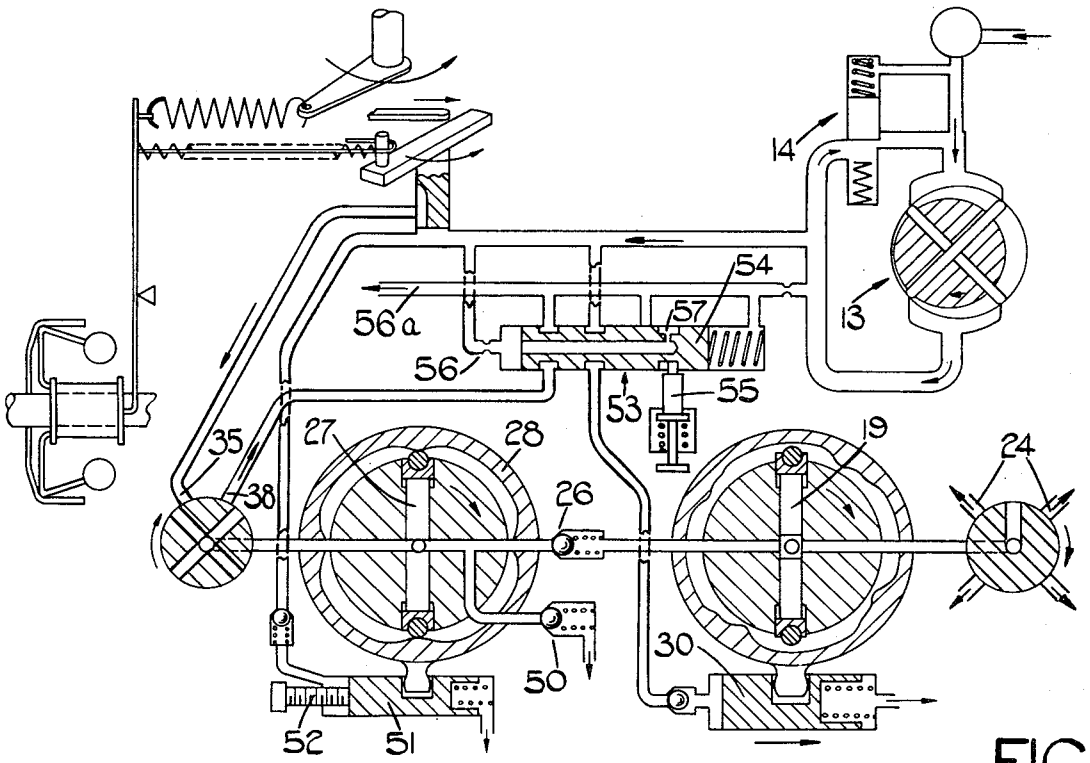
FIGS. 8, 9 and 10 show alternative fluid circuits of the apparatus.

Referring now to FIG. 8 of the drawings identical reference numerals are utilised wherever possible in relation to those portions of the apparatus which are complementary to the portions of the apparatus in FIGS. 1, 2, 3, 4 and 5.

FIG. 8 shows the aforesaid relief valve which is referenced 50 the purpose of which is to prevent an excessive rise in pressure when inward movement of the plungers 27 occurs. FIG. 8 also shows a fluid pressure operable piston 51 for varying the angular setting of the cam ring 28 and as will be seen the piston 51 is spring loaded in one direction to abut against a stop 52 which constitutes the maximum fuel stop.

In order to obtain excess fuel for starting purposes it is arranged that the spill port 38 is effectively closed thereby preventing fuel from being spilled either at the beginning or at the end of the inward movement of the plungers 27. For this purpose an excess fuel control valve indicated at 53 is provided and this includes a piston member 54 slidable within a cylinder. The piston member is spring loaded towards one end of the cylinder but it can be retained away from the end of the cylinder to which it is loaded, by means of a manually operable latch 55. When the latch 55 is released the piston member moves to the end of the cylinder. In the non-released position of the member 54 the port 38 communicated by way of a groove on the member 54, with a drain 56*a*. Moreover, the outlet of the pump 13 is in communication with the end of the cylinder containing the piston 30 and remote from the spring by way of a restriction 56. The end of the cylinder containing the spring is in communication with the drain and formed within the member is a passage extending towards the end of the member again which the spring bears, the passage including a restriction 57 and positioned to register when the latch 55 is released, with a port which again communicates with the drain. During normal operation of the member 54 is retained by the latch 55 and spillage of fuel as described takes place and also the piston 30 is subject to the outlet pressure of the pump. Moreover, the member 54 is held against the action of the spring by means of the outlet pressure of the feed-pump.

When it is required to start the associated engine and it is decided that excess fuel is required possibly because the engine is cold, the latch 55 is released and this has the effect of preventing spillage of fuel through the port 38 and also it isolates the cylinder containing the piston 30, from the outlet pressure of the feed pump.

As a result no spillage of fuel takes place and the full quantity of fuel which is taken in by the pump which includes the plungers 27, is passed to the injection pump and thereby an excess of fuel will be delivered by the apparatus to the engine. Moreover, the timing of injection will be retarded by virtue of the fact that the piston 30 will be moved its maximum extent by its spring loading. When the engine starts and its speed increases, the outlet pressure of the feed pump 13 will also increase and a flow of fuel will take place through the restrictors 56, 57 in series. The member 54 is effectively subject to the pressure between these two restrictors and a point will be reached at which the pressure is sufficient to move the member 54 against the action of its spring. Such movement allows spillage of fuel to take place and also permits operation of the timing piston 30. Moreover the latch 55 positively retains the piston 54 in the normal fuel position. The purpose of the restrictors 56 and 57 is to ensure that the member 54 only starts to move once the engine has started and has accelerated to above normal idling speed. Even if the latch 55 is released when the engine is operating, the pressure is applied to the member 54 such that the latter will be retained in the position shown so that it is only for starting purposes, that excess fuel can be obtained. It will be appreciated that the latch 55 may be omitted. In this case excess fuel would be obtained every time the engine was started. It should also be noted that the piston 51 is subject to the outlet pressure of the feed pump 13 and can move under the influence of this pressure against the action of the spring. Such movement will bring about a reduction in the delivery of fuel in the example where spillage of fuel occurs at the beginning of inward movement of the plungers 27.

Figure 9:
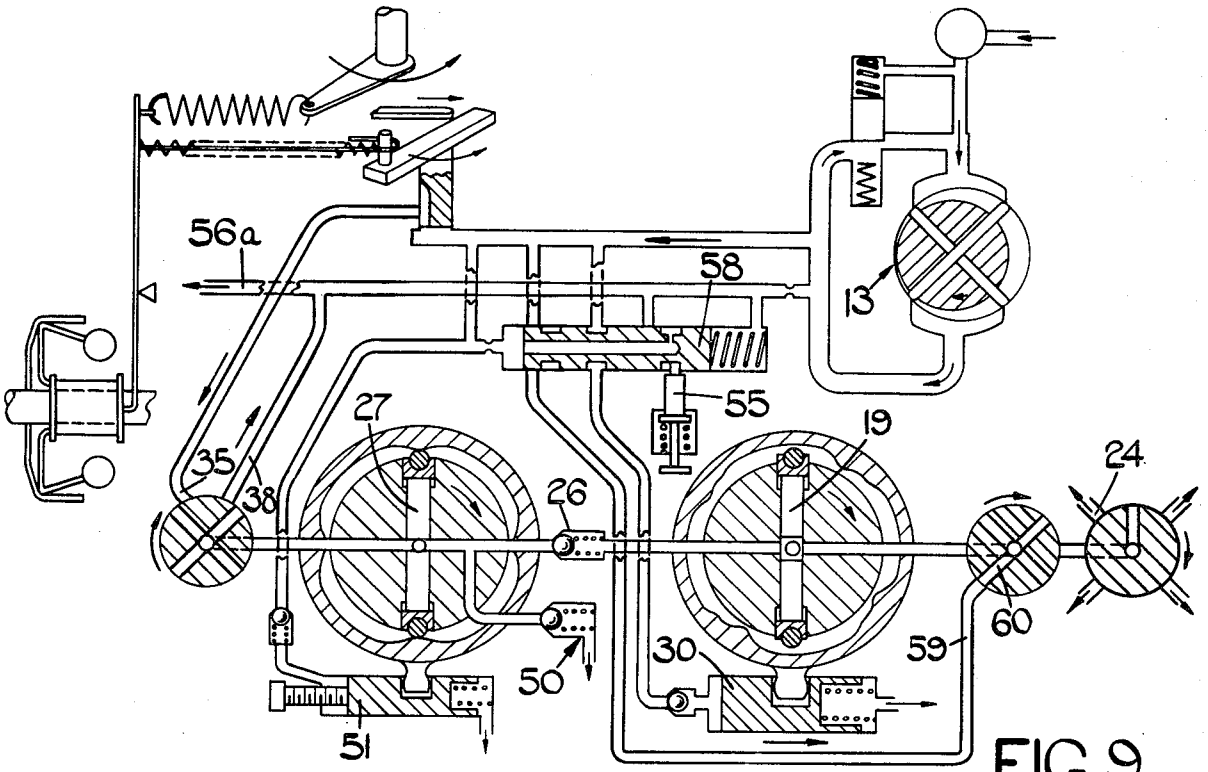

In the arrangement shown in FIG. 9 the relief valve 50 is an essential requirement because for the purpose of obtaining excess fuel for starting purposes, fuel is supplied directly to the bore containing the plungers 19 from the feed pump 13. Moreover, unlike the example shown in FIG. 8, the spill port 38 is in constant communication with the drain. The valve member 58 in many respects is similar to the valve member 54 and a latch 55 is provided as also are the restrictors 56 and 57. Moreover, the valve controls the application of the outlet pressure of the feed pump 13 to the piston 30 but it also when the latch 55 is released, permits communication between the outlet of the feed pump 13 and a special inlet port 59 which opens onto the periphery of the distributor member for registration with four additional inlet passages 60. An inlet passage 60 is brought into register with the inlet port 59 during the period when the plungers 19 can move outwardly. It is possible for the bore containing the plungers 19 to be filled with fuel by way of the special inlet port 59 and for one of the inlet passages 60 to have moved out of register with the inlet port 59 before the transfer of fuel takes place between the pumps. In this event the safety valve 50 will operate to prevent an excessive rise in pressure. On the other hand it can be arranged that the port 59 remains in communication with an inlet passage 60 until after the transfer of fuel has taken place and in this case if there is any surplus fuel it will merely flow back to the outlet of the feed pump. It will be appreciated that the volume of excess fuel will be determined by the permitted stroke of the plungers 19 whereas in the example of FIG. 8 it is the stroke of the plungers 27 which determines the volume of excess fuel.

Figure 10:
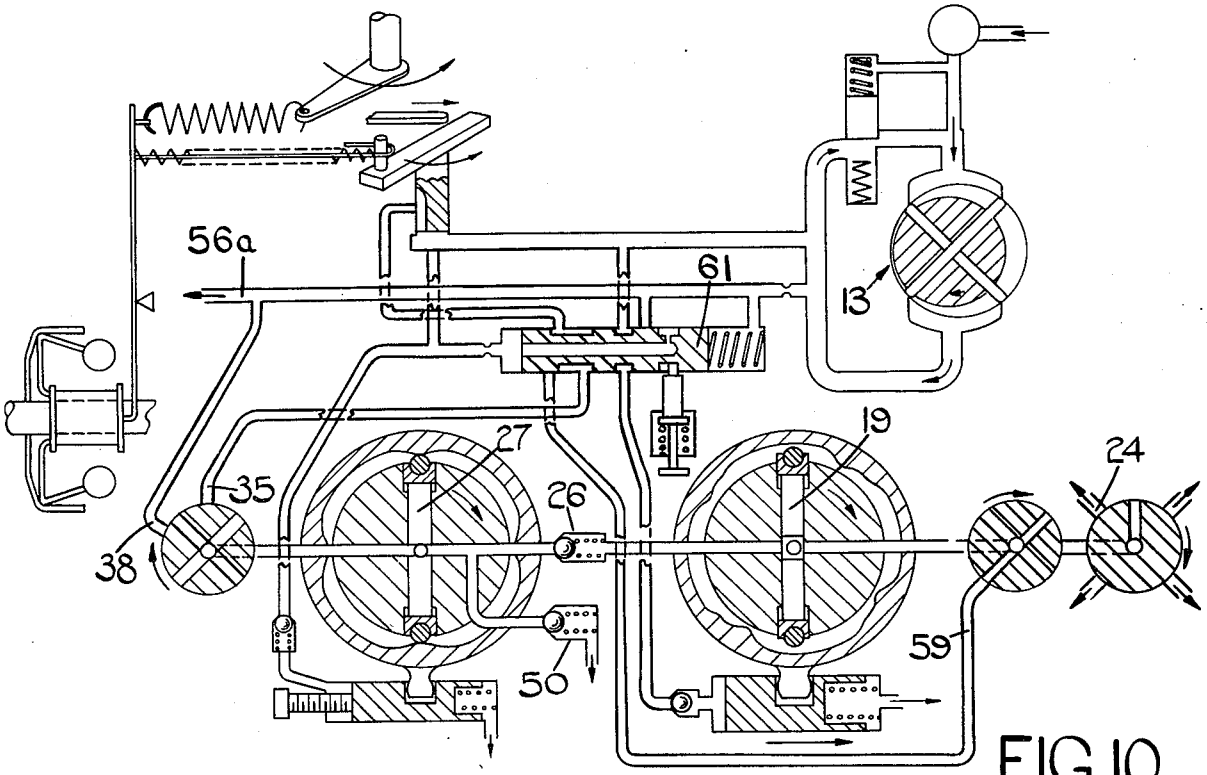

The arrangement which is shown in FIG. 10 is substantially the same as the arrangement shown in FIG. 9, however in this case when excess of fuel is required, the plungers 27 do not effect any transfer of fuel to the bore containing the plungers 19. This is achieved by ensuring that when the piston member 61 is allowed to move to a position in which excess fuel is supplied, communication between the port 35 and the outlet of the feed pump 13 by way of the throttle member is interrupted. Thus no fuel is supplied to the bore containing the plungers 27. An additional feature is the fact that the fuel which is supplied to the additional inlet port 59, flows by way of the throttle from the outlet of the feed pump. Thus the valve member 61 acts as a switch whereby during normal operation, fuel flows by way of the throttle member to the bore containing the plungers 27 and then to the bore containing the plungers 19. When excess fuel is required the fuel flows directly to the bore containing the plungers 19 by way of the throttle member.

We claim:

1. A liquid fuel injection pumping apparatus for supplying fuel to an internal combustion engine and comprising a housing, a rotary distributor member located in the housing, an injection pump including a bore formed in the distributor member, a pump plunger located in said bore, and cam means for imparting inward movement to said plunger as the distributor member rotates, a delivery passage in the distributor member through which the fuel displaced from said bore during the inward movement of the plunger flows, a plurality of outlet ports in the housing said delivery passage communicating with said outlet ports in turn as the distributor member rotates so that the fuel displaced during successive inward movements of the plunger will flow to the outlet ports in turn, a further bore formed in the distributor member or in a port rotatable therewith, a further plunger in said further bore, conduit means connecting said bores, further cam means for imparting inward movement to said further plunger as the distributor member rotates, said further cam means being positioned so that fuel will be displaced from said further bore through said conduit means to said first mentioned bore whilst the delivery passage is out of register with the outlet ports, valve means in said conduit means operable to allow fuel to flow to said first mentioned bore but to prevent the reverse flow of fuel, said valve means acting to ensure restriction to the flow of fuel to the first mentioned bore, and means operable in conjunction with said further cam means to determine the length of the stroke of said further plunger during which fuel can be delivered to said first mentioned bore.

2. An apparatus according to claim 1 in which the displacement of said further plunger is greater than the displacement of said first mentioned plunger and means is provided to spill fuel from said further bore at some time during the inward movement of the further plunger.

3. An apparatus according to claim 2 including a spill port opening into the periphery of the distributor member and a plurality of spill channels disposed about the distributor member and communicating with said further bore, one of said spill channels being brought into temporary register with said port during the time when inward movement of the further plunger can take place.

4. An apparatus according to claim 3 including means for adjusting the position of said further cam about the distributor member, in relation to the position of said spill port, whereby the amount of fuel supplied to the injection pump can be varied.

5. An apparatus according to claim 3 including a throttle for controlling the flow of fuel to the further bore during the period when the further plunger can move outwardly, the throttle acting to determine the amount of fuel delivered by the injection pump, the position of said further cam in relation to the spill port acting to determine the normal maximum quantity of fuel which can be supplied by the injection pump irrespective of the setting of said throttle.

6. An apparatus according to claim 5 including means operable to vary the position of said further cam in relation to the spill port thereby to vary the maximum amount of fuel which can be supplied to the engine.

7. An apparatus according to claim 6 including a piston connected to said further cam and passage means through which a fluid pressure can be applied to said piston, said fluid pressure varying in accordance with the speed at which the apparatus is driven.

8. An apparatus according to claim 5 in which said spill port and said spill channels are in register at the start of the inward movement of the further plunger, said spill port being shaped so that fuel can be transferred to the injection pump prior to a spill groove being moved out of register with a spill port, said shaping being such as to restrict the flow of fuel whereby the amount of fuel supplied to the injection pump will depend upon the speed of operation of the apparatus.

9. An apparatus according to claim 1 including mechanical means for determining the extent of inward movement of the further plunger under the action of the further cam.

10. An apparatus according to claim 9 in which said mechanical means is adjustable during operation of the apparatus to determine the amount of fuel supplied by the injection pump.

11. An apparatus according to claim 9 including a throttle for controlling the amount of fuel supplied to the further bore, said mechanical means acting to determine the maxmimum amount of fuel which can be supplied by the apparatus irrespective of the setting of said throttle.

12. An apparatus according to claim 9 in which said cam is in the form of a roller mounted in a radial slot formed in a port carried by the housing of the apparatus, said mechanical means comprising a member having an inclined surface engaged by said roller, the position of said member being adjustable to determine the radial position of said roller and thereby the extent of inward movement of the plunger, the apparatus including stop means acting to limit the outward movement of the plunger.

13. An apparatus according to claim 1 in which said valve means comprises a spring loaded non-return valve.

14. An apparatus according to claim 13 in which said non-return valve is housed within the distributor member or the part rotatable therewith.

15. An apparatus according to claim 13 in which said non-return valve is housed within a chamber formed in the housing of the apparatus, said housing defining a seating for a valve member.

16. An apparatus according to claim 15 in which the ends of said chamber are in constant communication with the bores respectively.

17. An apparatus according to claim 15 in which at least one end of said chamber has ported communication with the bores respectively.

18. An apparatus according to claim 15 in which the bore of the injection pump has ported communication with one end of said chamber, the other end of said chamber being in constant communication with the further bore.

19. An apparatus according to claim 1 in which said valve means comprises porting on the distributor member and housing, the apparatus including a relief valve through which surplus fuel can flow from said further bore.

20. An apparatus according to claims 4 or 5 in which the further cam is movable to obtain additional fuel for the purpose of starting the engine.

21. An apparatus according to claim 3 icluding valve means operable to prevent the flow of fuel through said spill port whereby the injection pump is completely filled with fuel for the purpose of supplying additional fuel for starting the engine, the apparatus further including a relief valve operable to prevent the generation of excessive fuel pressure in said further bore.

22. An apparatus according to claim 21 in which said valve means comprises a valve member which is biased towards a first position to prevent spillage of fuel and which is urged by the action of fluid under pressure to a second position in which spillage of fuel through the spill port can take place.

23. An apparatus according to claim 22 including manually operable latch means for retaining said valve member in said second position.

24. An apparatus according to claim 5 including valve means operable to allow fuel to be supplied to the injection pump from a source of fuel whereby the bore of the injection pump is completely filled with fuel for the purpose of providing additional fuel for starting purposes.

25. An apparatus according to claim 24 in which said valve means comprises a valve member which is biased towards a first position to alow the supply of fuel from said source and is movable to a second position in which the supply of fuel to the injection pump from said source is prevented, by the action of fluid under pressure.

26. An apparatus according to claim 25 in which the supply of fuel from said source to the injection pump takes place through said throttle.

27. An apparatus according to claims 25 or 26 including a manually operable latch for retaining said valve member in said second position.

* * * * *